US007649315B2

(12) United States Patent
Park et al.

(10) Patent No.: US 7,649,315 B2
(45) Date of Patent: Jan. 19, 2010

(54) PLASMA DISPLAY PANEL

(75) Inventors: Yong-Su Park, Yongin-si (KR); Ki-Dong Kim, Yongin-si (KR)

(73) Assignee: Samsung SDI Co., Ltd., Suwon-Si, Gyeonggi-do (KR)

( * ) Notice: Subject to any disclaimer, the term of this patent is extended or adjusted under 35 U.S.C. 154(b) by 300 days.

(21) Appl. No.: 11/605,789

(22) Filed: Nov. 29, 2006

(65) Prior Publication Data

US 2007/0120489 A1 May 31, 2007

(30) Foreign Application Priority Data

Nov. 30, 2005 (KR) ..... 10-2005-0115611

(51) Int. Cl.
*H01J 17/49* (2006.01)

(52) U.S. Cl. ..... 313/582

(58) Field of Classification Search ..... 313/582–587, 313/491

See application file for complete search history.

(56) References Cited

U.S. PATENT DOCUMENTS 6,013,309 A 1/2000 Kim et al.
2005/0134178 A1* 6/2005 Kim ..... 313/587

FOREIGN PATENT DOCUMENTS

EP 1564777 A1 * 8/2005
JP 2001-243886 9/2001
KR 1998-073657 5/1998
KR 10-1998-0018354 12/1999
KR 10-2005-0039240 4/2005

OTHER PUBLICATIONS

English Translation of JP 2001-243886 A.*

* cited by examiner

*Primary Examiner*—Toan Ton
*Assistant Examiner*—Hana A Sanei
(74) *Attorney, Agent, or Firm*—Knobbe Martens Olson & Bear LLP

(57) ABSTRACT

A plasma display panel (PDP) according to one embodiment includes: a first substrate and a second substrate that are disposed substantially in parallel with each other with a predetermined distance therebetween; a plurality of address electrodes disposed on the first substrate; a first dielectric layer disposed on an entire surface of the first substrate while covering the address electrodes; a plurality of barrier ribs having a predetermined height from the first dielectric layer and disposed in a space between the first substrate and the second substrate to partition the space into discharge spaces of a predetermined size; a phosphor layer disposed in the discharge spaces; a plurality of display electrodes disposed on one side of the second substrate facing the first substrate in a direction crossing the address electrodes; a second dielectric layer disposed on an entire surface of the second substrate to cover the display electrodes; and a protective layer disposed to cover the second dielectric layer. The protective layer includes MgO having a crystalline grain size ranging from 100 to 500 nm and has a membrane density of less than or equal to 3.3 g/cm$^3$.

7 Claims, 6 Drawing Sheets

PLASMA DISPLAY PANEL

CROSS-REFERENCE TO RELATED APPLICATION

This application claims priority to and the benefit of Korean Patent Application No. 10-2005-0115611 filed in the Korean Intellectual Property Office on Nov. 30, 2005, the entire contents of which are incorporated herein by reference.

BACKGROUND OF THE INVENTION

1. Field of the Invention

The present embodiments relate to a plasma display panel where the display quality is improved by controlling a crystalline grain diameter and the membrane density of a protective layer.

2. Description of the Related Art

A plasma display panel (PDP) is a display device that forms an image by exciting phosphor with vacuum ultraviolet (VUV) rays generated by gas discharge in discharge cells. Since a PDP is capable of realizing a large, high-resolution screen, it is drawing attention as a next-generation thin display device.

PDPs are broadly classified into alternating current (AC) types and direct current (DC) types. AC PDPs are most widely used.

The AC PDP has a basic structure where two electrodes are arranged crossing each other between two substrates that face each other and are filled with a discharge gas and partitioned by barrier ribs. One electrode is coated with a dielectric layer for generating wall charges and the other electrode is disposed opposite thereto and coated with a phosphor layer. On the dielectric layer, a protective layer that is generally composed of MgO is disposed.

The protective layer has sputtering resistance to compensate the affect due to the ion bombardment of the discharge gas while the plasma display panel is discharged. The protective layer is covered on the dielectric layer in the form of a transparent protective thin film having a thickness of 3,000 to 7,000 Å, which protects the dielectric layer from the ion bombardment and lowers the discharge voltage through the secondary emission of electrons.

Since the characteristics of the protective layer are widely varied depending upon the conditions of the heat depositing process and the layer-forming process, it is hard to maintain display quality within a certain level. The protective layer may cause black noise due to an address discharge delay, which is an address miss where light is not emitted in the selected cell. Black noise generally occurs in a boundary between a light-emitting region and a region where no light is emitted, but may occur in a certain region. An address miss occurs at low intensity when there is no address discharge or when a scan discharge is progressed. Accordingly, research for diminishing the address discharge delay time has been done to prevent the black noise and the discharge miss.

Nowadays, the protective layer for the PDP is generally composed of MgO materials, and formed by sputtering, electron beam plating, ion beam assisted deposition (IBAD), chemical vapor deposition (CVD), and sol-gel processes, but the electron beam plating (EB) process is commonly adapted.

The electron beam plating process forms a MgO protective layer and includes the steps of colliding the electron beam accelerated to the electric field and the magnetic field with a MgO depositing material, and heating and evaporating the depositing material. However, the electron beam plating process has the disadvantage that more production devices are installed if mass production is required to be as much as 60 to 70 Å/sec since the deposition speed is prolonged due to the limit of the heat source of the electron spot source. Further, as it is dependent upon only the acceleration energy generated from the potential difference, the acceleration intensity thereof is insufficient and it limits the forming of a dense protective layer.

SUMMARY OF THE INVENTION

One embodiment of the present embodiments provide a plasma display panel where the display quality is improved by controlling the crystalline grain diameter and the membrane density.

According to one embodiment, a plasma display panel (PDP) is provided that includes: a first substrate and a second substrate that are disposed substantially in parallel with each other with a predetermined distance therebetween; a plurality of address electrodes disposed on the first substrate; a first dielectric layer disposed on an entire surface of the first substrate while covering the address electrodes; a plurality of barrier ribs having a predetermined height from the first dielectric layer and disposed in a space between the first substrate and the second substrate to partition the space into discharge spaces of a predetermined size; a phosphor layer disposed in the discharge spaces; a plurality of display electrodes disposed on one side of the second substrate facing the first substrate in a direction crossing the address electrodes; a second dielectric layer disposed on an entire surface of the second substrate while covering the display electrodes; and a protective layer disposed to cover the second dielectric layer. The protective layer includes MgO having a crystalline grain diameter from about 100 to about 500 nm and has a membrane density of less than or equal to about 3.3 g/cm$^3$.

The MgO protective layer may be formed by ion-plating fused MgO.

DETAILED DESCRIPTION OF THE INVENTION

Figure 1:
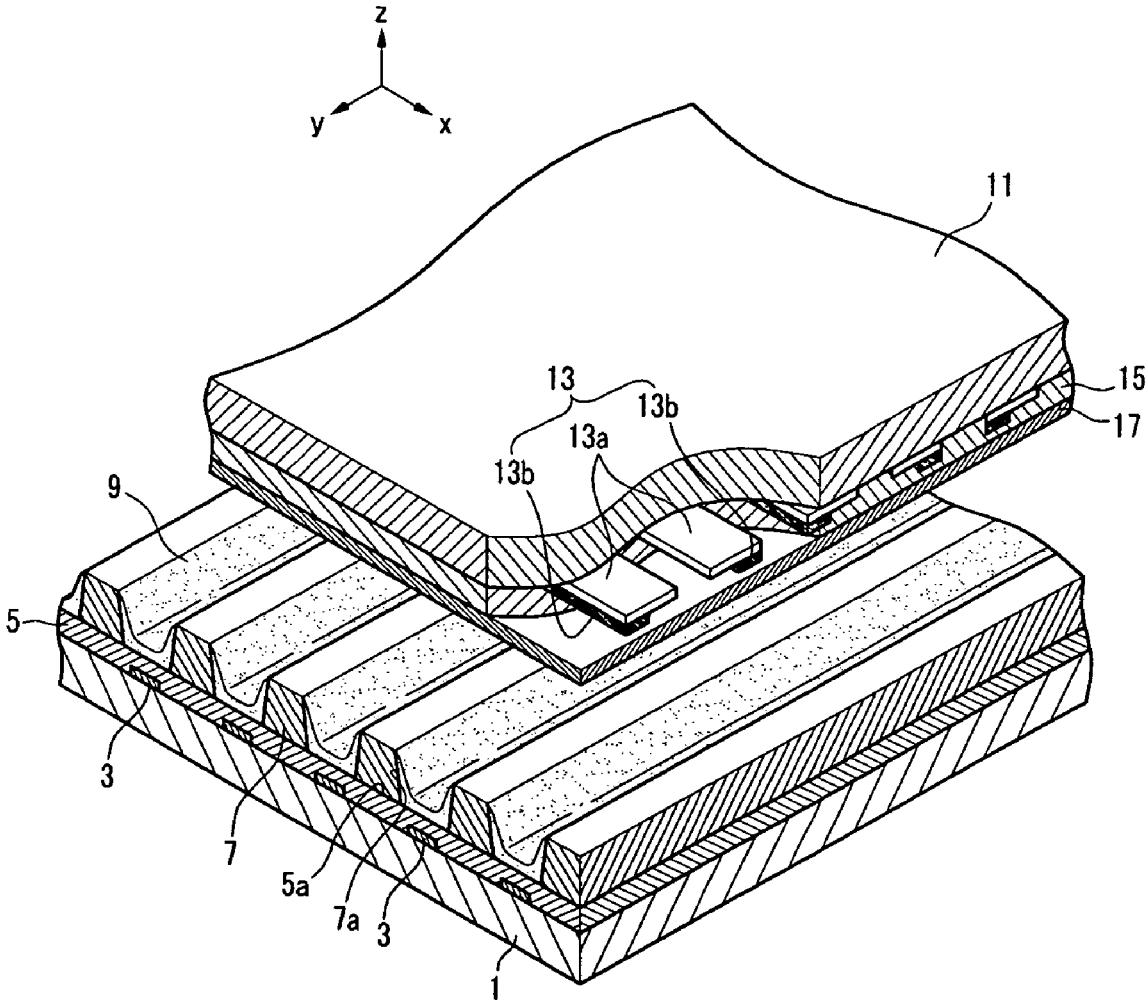
FIG. 1 is a partial exploded perspective view showing a plasma display panel (PDP) according to one embodiment.

Exemplary embodiments will hereinafter be described in detail with reference to the accompanying drawings.

One embodiment provides a plasma display panel where the display quality is improved by controlling the crystalline grain diameter and membrane density of a MgO protective layer upon forming the MgO protective layer. It is possible to provide a protective layer where the sputtering resistance is improved, the response speed is constant even if the temperature is changed, and discharge reliability is improved.

As the MgO protective layer is contacted with a discharge gas in the plasma display panel (PDP), the discharge characteristics of the PDP are remarkably dependent upon the characteristics of the MgO protective layer. The characteristics of the MgO protective layer are determined mainly by a crystal structure of MgO oxide, a crystalline grain diameter, a physical property such as the membrane density thereof, and the coating condition during the deposition. Accordingly, the composition and the condition of the protective layer are designed and optimized to improve the characteristics thereof. Thereby, the PDP can improve the discharge characteristic and the display quality.

Generally, the secondary electron emitting characteristic of the protective layer is improved on exposing it to the plasma if the crystalline degree of MgO is higher and the crystal grain diameter of MgO is bigger. In the case of satisfying these conditions, it is possible to minimize the variation of the gamma characteristic of the plasma display panel. The denser the membrane density of the MgO protective layer is, the more the sputtering resistance is increased. Thereby, the life-span of the plasma display panel is increased to realize a stable image.

According to one embodiment, the MgO protective layer has a single crystal structure in order to satisfy the conditions mentioned above. The crystal grain diameter is from about 100 to about 500 nm, preferably from about 100 to about 400 nm, and more preferably from about 150 to about 300 nm. The membrane density is about 3.3 g/cm$^3$ or less, and preferably is from about 1.0 to about 3.3 g/cm$^3$. Thereby, the secondary electron emission property (gamma characteristic) and the sputtering resistance are improved to lower the discharge initiating voltage and the discharge sustain voltage. Further, the variation of the secondary electron emission property is minimized depending upon the temperature so that the address miss or the black noise caused by the address discharge delay is prevented to improve the display quality. The black noise indicates a phenomenon where light is not emitted in a cell selected to emit light.

Such characteristics can be provided by using fused MgO and forming the MgO protective layer in accordance with an ion-plating process.

The fused MgO is prepared by a cooling process and has less impurities compared to conventional MgO prepared by a firing process. Accordingly, it is easily formed as a single crystal structure and improves the crystallinity of the protective layer.

Fused MgO prepared in accordance with one embodiment and conventional MgO prepared in accordance with a firing process are used to provide MgO protective layers. The response speed thereof is measured, and the results show that the fused MgO of one embodiment has a relatively constant gamma characteristic (secondary electron emission characteristic) thereby obtaining a stable discharge characteristic.

The MgO protective layer is provided by an ion-plating process.

The ion-plating process includes colliding the electron beam accelerated to the electric field and the magnetic field with a MgO depositing material, and heating and evaporating the depositing material. Such process is carried out at a higher temperature than that of the conventional coating process for a thin film such as electron beam plating, vacuum depositing, and so on. Thereby, the mobility of the particles, and the membrane density thereof, are increased to provide a uniform layer due to the activating effect of the discharge.

The ion-plating process is not so limited, however, and includes triode ion-plating, magnetron ion-plating, ion-plating using a hollow cathode, R.F. bias ion-plating, high vacuum ion-plating, reactive ion-plating, etc.

In order to carry out such ion-plating deposition, suitable reactive conditions are previously designed. Specifically, the reactive conditions may include the process pressure, the $H_2O$ partial pressure, the bias voltage intensity, the flux of the inert gas, the current density, and the deposition speed. The reactive conditions may be determined depending upon the ion-plating device, and the specific level thereof may be determined by one having ordinary skill in this art. For example, the ion-plating is carried out by applying the bias voltage under the predetermined pressure with inflowing the inert gas at a constant speed. According to one embodiment, the process pressure may be controlled to be within the range of $1\times10^{-4}$ to $1\times10^{-9}$, the $H_2O$ partial pressure may be controlled to be within the range of $1\times10^{-3}$ to $1\times10^{-5}$, and the deposition speed may be controlled to be within the range of 3000 to 7000 Å/min It is possible to provide a MgO protective layer including a bigger crystalline grain diameter of MgO prepared by the ion-plating compared to that of the conventional electron beam emitting process.

As described in the following Examples, MgO protective layers are prepared in accordance with the ion-plating and the electron beam plating and the crystalline grain diameters of the protective layers are measured. The results show that the crystalline grain diameter of the protective layer prepared by the ion-plating is coarser, and so the discharge characteristic is improved. Therefore, the display quality of the PDP according to one embodiment is improved.

The protective layer preferably has a thickness of about 500 nm or more, and more preferably is from about 500 to about 9000 nm. Further, the transmittance is preferably about 90% or more, and more preferably from about 90 to about 98%. The refractive index at about 650 nm preferably is from about 1.45 to about 1.74.

One example of the plasma display panel including the protective layer according to one embodiment is illustrated in FIG. 1.

FIG. 1 is a partial exploded perspective view showing a PDP according to an embodiment, but the present embodiments are not limited thereto. Referring to the drawing, the PDP includes a first substrate 1, a plurality of address electrodes 3 disposed in one direction (a Y direction in the drawing) on the first substrate 1, and a dielectric layer 5 disposed on the entire surface of the first substrate 1 covering the address electrodes 3. Barrier ribs 7 are formed on the dielectric layer 5, and red (R), green (G), and blue (B) phosphor layers 9 are disposed on a bottom surface 5*a* and sides 7*a* of discharge cells formed between the barrier ribs 7. A layer for lowering reflective brightness may be disposed on the tops of the barrier ribs 7

Display electrodes 13, each including a pair of a transparent electrode 13*a* and a bus electrode 13*b*, are disposed in a direction crossing the address electrodes 3 (an X direction in the drawing) on one surface of a second substrate 11 facing the first substrate 1. Also, a transparent dielectric layer 15 and a protective layer 17 are disposed on the entire surface of the second substrate 11 while covering the display electrodes 13. The protective layer 17 preferably includes a MgO protective layer with a crystalline grain diameter of the MgO from about 100 to about 500 nm, preferably from about 100 to about 400 nm, and more preferably from about 150 to about 300 nm, and a membrane density thereof of about 3.3 g/cm$^3$. The discharge cells are formed at positions where the address electrodes 3 are crossed by the display electrodes 13.

When an address voltage (Va) is applied between an address electrode 3 and a display electrode 13, an address discharge is generated. Further, when a sustain voltage (Vs) is applied between a pair of display electrodes 13, vacuum ultraviolet rays generated upon the sustain discharge excites a corresponding phosphor layer 9 to emit visible light though the transparent front substrate 11.

According to another embodiment, the plasma display panel is fabricated by the method including: a) providing an address electrode and a first dielectric layer on a first substrate; b) forming barrier ribs for partitioning a discharge space to thereby form partitioned discharge spaces on the entire surface of the first dielectric layer and then forming a phosphor layer in the partitioned discharge spaces; c) providing a display electrode and a second dielectric layer on a second substrate; d) providing a protective layer by ion-plating fused MgO on the entire surface of the second dielectric layer; and e) facing the first substrate and the second substrate to each other, assembling, sealing, exhausting air therebetween, and injecting a discharge gas, and aging them.

According to the method for fabricating the plasma display panel (PDP), the MgO protective layer may be prepared by ion-plating fused MgO.

The following examples illustrate the present embodiments in more detail. However, it is understood that the present embodiments are not limited by these examples.

EXAMPLE 1

On an upper substrate of soda lime glass, display electrodes were formed into a stripe shape using an indium tin oxide conductive material in accordance with the generally used method in this art.

Subsequently, a lead-based glass paste was coated on the entire surface of the upper substrate while covering display electrodes and fired to provide a second dielectric layer.

Fused MgO was ion-plated on the second dielectric layer to provide a MgO protective layer.

COMPARATIVE EXAMPLE 1

A fused MgO protective layer was prepared in accordance with the conventional electron beam plating (EB) process.

COMPARATIVE EXAMPLE 2

A fired MgO protective layer was prepared by the ion-plating in accordance with Example 1, except that commercially available fired MgO was used instead of fused MgO.

EXPERIMENTAL EXAMPLE 1

Comparison of Response Speed Depending Upon Deposition Process

Figure 2:
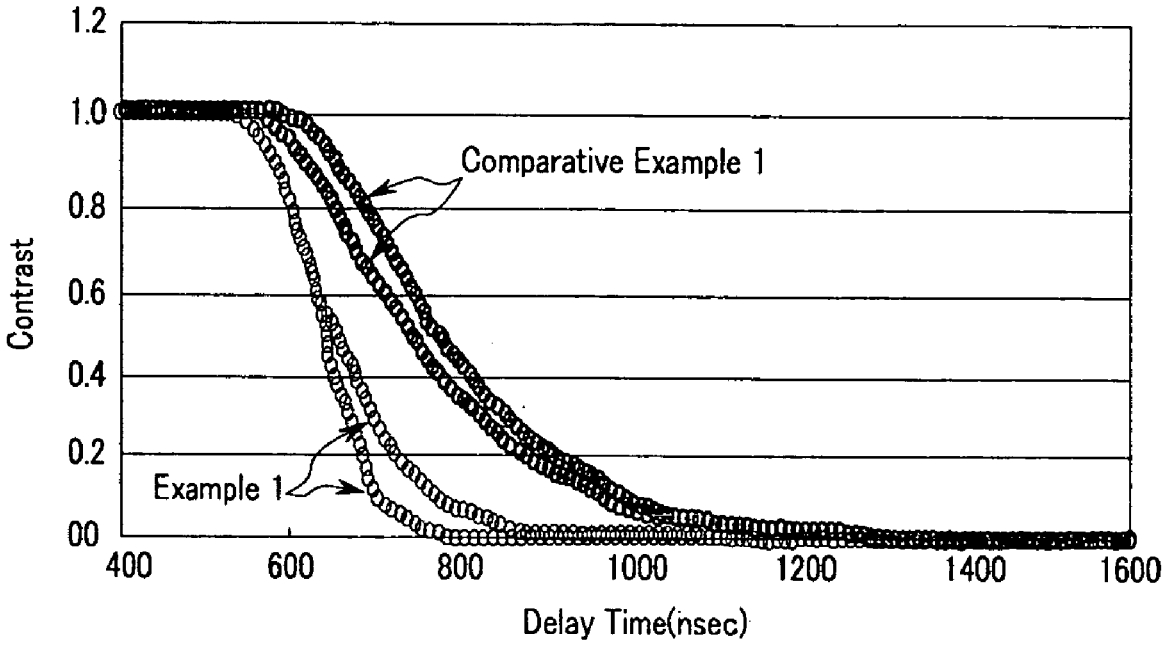
FIG. 2 is a graph showing the response speed of MgO protective layers according to Example 1 and Comparative Example 1.

To compare the difference between the ion-plating and the electron beam plating, the protective layers according to Example 1 and Comparative Example 1 were measured two times to determine the response speed, and the results are shown in FIG. 2. The response speed is determined when the white level (contrast 1.0) is changed to the black level (contrast 0.0) by applying a voltage. A delayed response speed may cause an after image when an image is continuously displayed.

Referring to FIG. 2, the protective layer prepared by the ion-plating in accordance with Example 1 has a shorter delay time than that of the electron beam plating in accordance with Comparative Example 1. From the results, it can be seen that the response speed was improved due to the ion-plating.

EXPERIMENTAL EXAMPLE 2

Comparison of Crystalline Grain Diameter

To compare the crystalline grain diameters of the protective layers prepared by the ion-plating and the electron beam plating, the surfaces of the protective layers according to Example 1 and Comparative Example 1 were observed by a scanning electron microscope. The obtained results are shown in FIG. 3A (Example 1) and FIG. 3B (Comparative Example 1).

Figure 3A:
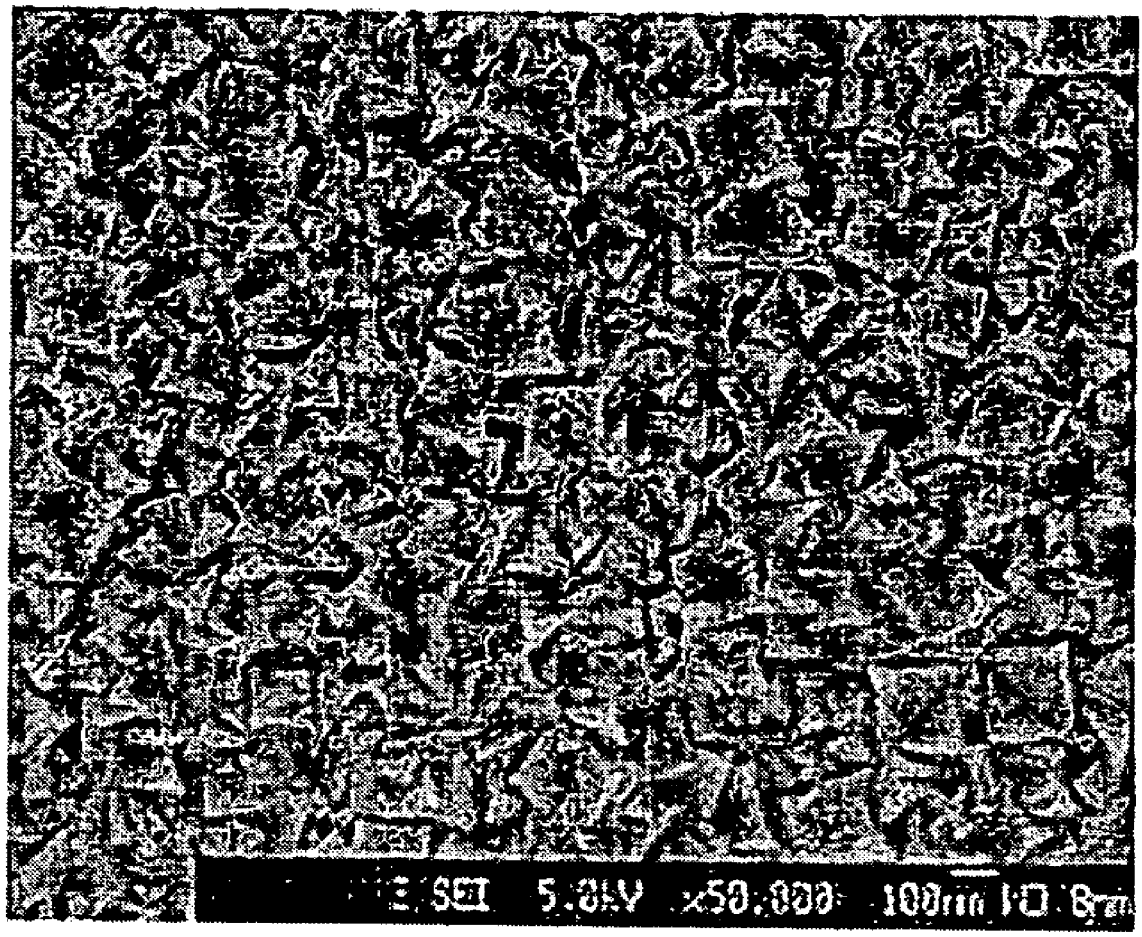
FIG. 3A is a scanning electron microscope (SEM) photograph showing the surface of the MgO protective layer according to Example 1 and FIG. 3B is a SEM photograph showing the surface of the MgO protective layer according to Comparative Example 1.
Figure 3B:
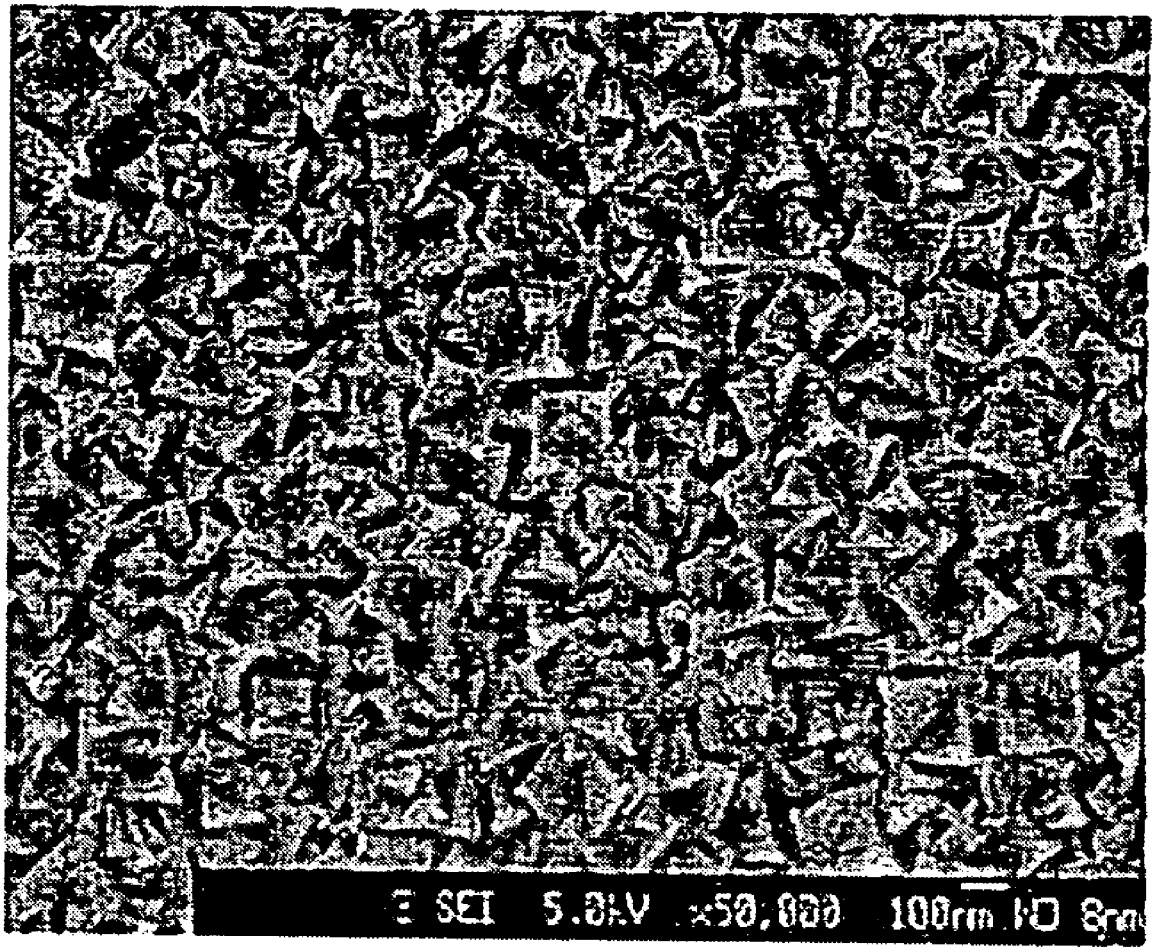

Referring to FIG. 3A, the MgO protective layer prepared by the ion-plating in accordance with Example 1 was composed of single-crystalline MgO with a crystalline grain diameter ranging from about 100 to 200 nm, and a membrane density thereof was 3.0 g/cm$^3$. The refractive index at 650 nm of the MgO protective layer was 1.64.

The MgO protective layer prepared by the electron beam plating in accordance with Comparative Example 1 had a refractive index at 650 nm of 1.62. From the results, it shows that it was composed of single-crystalline MgO. However, the crystalline grain diameter of MgO ranged from 30 to 80 nm. Therefore, it is confirmed that it has a smaller crystalline grain diameter than that of the MgO prepared by the ion-plating in accordance with Example 1.

EXPERIMENTAL EXAMPLE 3

Comparison of Growing Crystalline Grain

Figure 4:
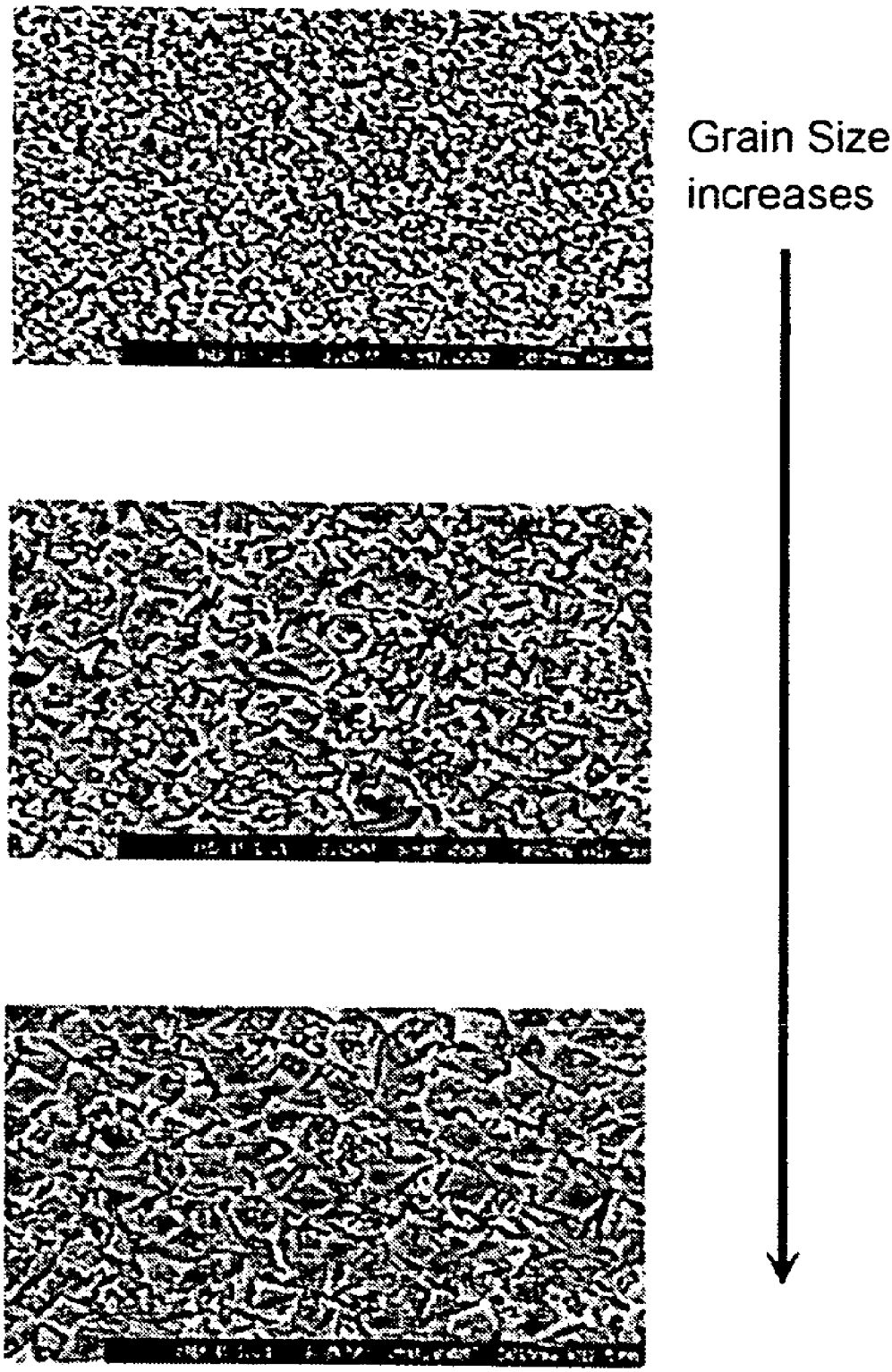
FIG. 4 is SEM photographs showing the growing crystalline grain of the MgO protective layer according to Example 1.

To find how the crystalline grain of the protective layer was controlled by the ion-plating, the surface of the protective layer according to Example 1 was observed by a scanning electron microscope and the results are shown in FIG. 4.

The scanning electron microscope photographs of FIG. 4 show that the crystalline grain diameter of the protective layer was increased upon progressing the ion-plating. From the results, it is confirmed that the crystalline grain diameter of the protective layer is controlled by changing the condition of the ion-plating.

EXPERIMENTAL EXAMPLE 4

Discharge Characteristics Depending Upon MgO Materials

To compare how the response speed of the protective layer is changed between using fused MgO or fired MgO, the relative response speeds of the protective layers prepared by Example 1 and Comparative Example 2 were measured with changing the temperature. The obtained results are shown in FIG. 5.

Figure 5:
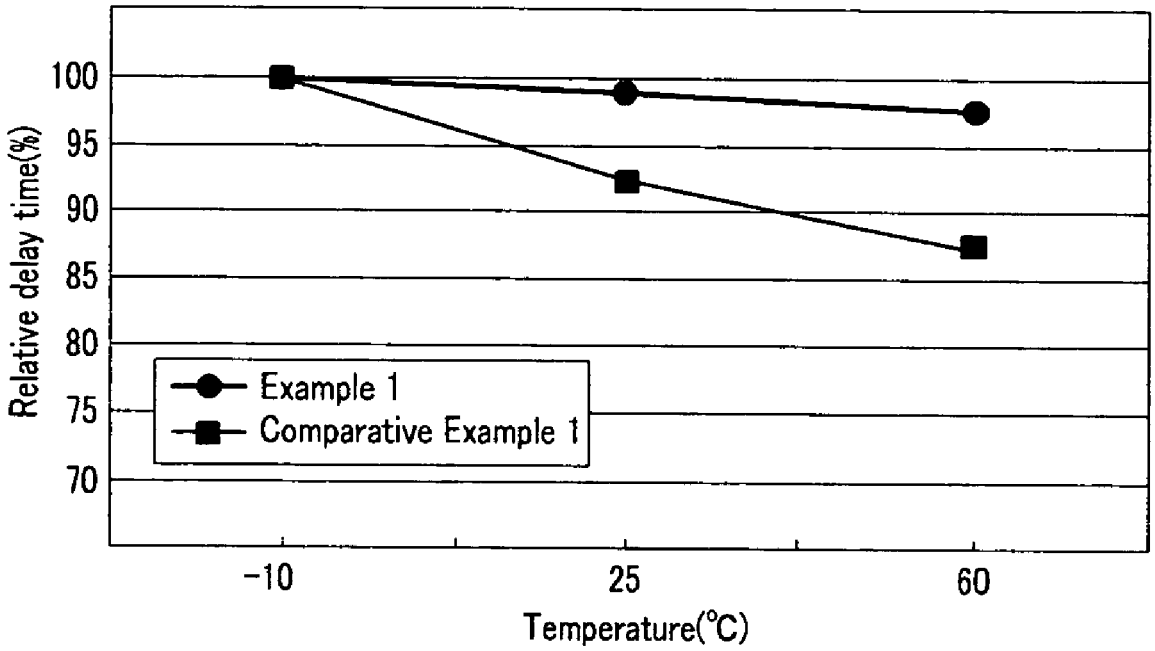
FIG. 5 is a graph showing the response Speed Depending upon the temperature of the MgO protective layers according to Example 1 and Comparative Example 2.

Referring to FIG. 5, the MgO protective layer using fused MgO according to Example 1 relatively maintained a constant response speed even when the temperature was changed from −10 to 60° C. From the results, it is confirmed that it is possible to provide a stable discharge characteristic. This is because the secondary electron emission characteristic is increased due to using fused MgO when it is exposed to the plasma. Thereby, the variation of the gamma characteristic is minimized.

However, the MgO protective layer prepared by using fired MgO according to Comparative Example 2 showed an unstable discharge characteristic where the response speed was remarkably decreased depending upon the temperature.

As mentioned above, the plasma display panel according to one embodiment includes a MgO protective layer prepared by ion-plating fused MgO. Therefore, it is easy to control the crystal grain diameter so that the discharge characteristic is improved and the display quality is improved.

While these embodiments have been described in connection with what is presently considered to be practical exemplary embodiments, it is to be understood that the embodiments are not limited to the disclosed embodiments, but, on the contrary, is intended to cover various modifications and equivalent arrangements included within the spirit and scope of the appended claims.

What is claimed is:

1. A plasma display panel comprising:

a first substrate and a second substrate that are disposed substantially in parallel with each other with a predetermined distance therebetween;

a plurality of address electrodes disposed on the first substrate;

a first dielectric layer disposed on a surface of the first substrate while covering the address electrodes;

a plurality of barrier ribs having a predetermined height from the first dielectric layer and disposed in a space between the first substrate and the second substrate;

a phosphor layer disposed in the discharge spaces;

a plurality of display electrodes disposed on one side of the second substrate facing the first substrate in a direction crossing the address electrodes;

a second dielectric layer disposed on a surface of the second substrate to cover the display electrodes; and a protective layer disposed to cover the second dielectric layer, wherein the protective layer comprises MgO having a crystalline grain diameter from about 100 to about 500 nm and a membrane density of less than or equal to about 3.3 $g/cm^3$ wherein the MgO protective layer has a single crystal structure.

2. The plasma display panel according claim 1, wherein the MgO has a crystalline grain diameter from about 100 to about 400 nm.

3. The plasma display panel according claim 1, wherein the MgO has a crystalline grain diameter from about 150 to about 300 nm.

4. The plasma display panel according to claim 1, wherein the MgO protective layer has a transmittance of about 90% or more and a refractive index at about 650 nm from about 1.45 to about 1.74.

5. The plasma display panel according to claim 1, wherein the MgO protective layer has a thickness from about 500 to about 9000 nm.

6. The plasma display panel according to claim 1, wherein the MgO protective layer comprises fused MgO.

7. The plasma display panel according to claim 1, wherein the MgO protective layer is formed by ion-plating fused MgO.

* * * * *